United States Patent [19]

Meckler

[11] Patent Number: 4,815,527

[45] Date of Patent: Mar. 28, 1989

[54] MULTI-ZONE OFF-PEAK STORAGE ON-PEAK ENERGY SAVING AIR CONDITIONING

[76] Inventor: Milton Meckler, 16348 Tupper St., Sepulvida, Calif. 91343

[21] Appl. No.: 130,648

[22] Filed: Dec. 9, 1987

[51] Int. Cl.[4] ..... F24F 3/00

[52] U.S. Cl. ..... 165/50; 62/59; 62/99; 62/435

[58] Field of Search ..... 62/59, 435, 233, 99; 165/18, 61, 50

[56] References Cited

U.S. PATENT DOCUMENTS

| | | | |
|---|---|---|---|
| 2,935,857 | 5/1960 | McFarlan | 62/203 X |
| 3,247,679 | 4/1966 | Meckler . | |
| 3,653,221 | 4/1972 | Angus | 62/59 |
| 3,996,759 | 12/1976 | Meckler | 62/238.6 |
| 4,011,731 | 3/1977 | Meckler . | |
| 4,033,740 | 7/1977 | Meckler . | |
| 4,122,893 | 10/1978 | Thompson | 165/22 X |
| 4,165,036 | 8/1979 | Meckler | 62/238.6 |
| 4,270,362 | 6/1981 | Lancia et al. | 62/203 X |
| 4,294,083 | 10/1981 | King | 62/59 X |
| 4,419,864 | 12/1983 | McFarlan | 62/98 |
| 4,522,253 | 6/1985 | Levin | 165/18 |
| 4,559,788 | 12/1985 | McFarlan | 62/238.6 |
| 4,691,530 | 9/1987 | Meckler | 62/331 |

*Primary Examiner*—William E. Wayner

*Attorney, Agent, or Firm*—William H. Maxwell

[57] ABSTRACT

An air conditioning system characterized by a multiplicity of conditioned zone and downsized compressors within separately operable mechanical refrigeration air conditioners which can be of varied types including simple refrigeration units or heat pump units and either of which can be air source or water source, and each of which is equipped with a wet economizer air cooling coil, and which also can be equipped with a charging coil, and all of which are connected by control valves into a common support system for the on-peak storage of chilled water and tempered water and with an ice maker supplying ice water, the compressors of the air conditioners and of the ice maker being deactivated during on-peak power periods, and the tempered water of the support system incorporating a fire sprinkler system.

55 Claims, 6 Drawing Sheets

P2
P2
P1
R2
R1
BOILER
55°-90° F
TEMPERED
35°-40° F
ICE
M
P
D
E
T2
A1
B1
R
F

P2
P2
P1
R2
R1
BOILER
55°-90° F
TEMPERED
35°-40° F
ICE
61°-68° F
CHILLED
T1
T2
D
E
F
F1
F2
A1
B1
G
R
M
P

B1
A-A1
R
57
59
58
64
61
60
62
63
16
14
15
17

B
A-A1
C
R
57
65
59
66
60
62
58
64
67
61
63
16
14
15
17

MULTI-ZONE OFF-PEAK STORAGE ON-PEAK ENERGY SAVING AIR CONDITIONING

BACKGROUND OF THE INVENTION

This invention relates to air conditioning involving at least one and preferably a multiplicity of zones to be conditioned on a day to day basis, and characterized by full use of electrical power during off-peak hours and by minimal use thereof during on-peak hours. It is a general object of this invention to substantially reduce the use of electrical power during on-peak hours of the day, whereby the load imposed upon Utility power sources is reduced during prime time when the cost rates therefor are usually higher than during the off-peak hours. A characteristic feature of this invention is that the heat and cold producing functions are preferably operative during off-peak hours, and that only circulation fans and pumps are preferably operative during on-peak hours. It is known that the compressor units of refrigeration and heat pump air conditioners use relatively large amounts of electrical power, whereas the circulation fans and pumps use relatively small amounts of electrical power. However, the operation of circulation fans and pumps is quite necessary for air and liquid distribution. Accordingly, the refrigerant compressor of the system herein disclosed may not consume electrical power during the critical time periods when the Utility power source tends to be or is most likely to be over loaded. In practice, timer means is employed to selectively determine off-peak operation of said refrigerant compressor or compressors.

Air conditioning units vary widely in type and mode of operation. A first and basic refrigeration air conditioner is the Air Source Refrigeration Unit as shown in FIG. 11, wherein a compressor circulates refrigerant through a condenser and then through an expansion device and through an evaporator or air handling coil, and with an air circulating fan removing heat of compression from the condenser. A second refrigeration air conditioner is the Water Source Refrigeration Unit as shown in FIG. 10, which is like that of FIG. 11 except that the condenser is a liquid to liquid heat exchanger that removes the heat of compression. A third refrigeration air conditioner is the Air Source Heat Pump Unit as shown in FIG. 9, wherein refrigerant is switched by a valve so as to flow reversely through the condenser and the evaporator, and with an air circulating fan to remove the heat of compression or cold from the coil externally of the conditioned air. And, a fourth refrigeration air conditioner is the Water Source Heat Pump as shown is FIGS. 4 and 8, which is like that of FIG. 9 except that the external condenser-evaporator is a liquid to liquid heat exchanger that transfers heat. As shown, each of the aforesaid units has an air handling coil A and an air cooling coil R. Additionally, each of the aforesaid units may have a charging coil C. As shown in FIG. 4, the heat pump is of the water source type, which may also be applied to the heat pump of FIG. 9. Accordingly, it is an object of this invention to advantageously employ any one or all of the aforesaid types of refrigeration air conditioners with coils A and R, and with or without coil C, all in combination with a common support system characterized by an ice maker and storage means; known generally as an "Ice Machine".

This invention is characterized by the ice machine shown throughout the drawings (see FIG. 3), and by the pipe system therefrom that supplies ice water to at least one and preferably any one or all of the plurality of varied types of refrigeration air conditioners, as hereinafter described. As shown, the two pipes supply ice water through the wet economizer air cooling coil R of each refrigeration air conditioner equipped therewith, and the multiplicity of these air conditioners are in parallel between the pipes. It is an object of this invention that each varied type of refrigeration air conditioner is independently operable and each individually supported by the ice maker and storage means to supplement the compressor capacity thereof or to supply the entire need for cooling thereof when the compressor thereof is out of service during on peak hours.

When Water Source Refrigeration air conditioners are employed, the support system advantageously employs a cooling tower in combination therewith and with the icemaker and storage means, it being an object of this invention that these functions cooperate efficiently. Another object is that these functions operate through a pipe system to any one or a multiplicity of "Water Source" refrigeration air conditioners, whatever type they may be, and which are in parallel (see FIG. 3).

The operational graphs of FIGS. 2 and 6 illustrate air conditioner, compressor, load and capacity as related to peak or total cooling function requirements, and timing with respect to off-peak and on-peak hours of the day. The heating function requirements are met in a cooperative manner by storing the heat of compression drawn from the condensers of the air conditioner and/or from the ice maker and storage means. It is therefore an object of this invention, as will be seen from said graphs, to employ undersized compressors in the air conditioner units. That is, the compressor capacities thereof fall short of the total peak cooling requirements. However and with this inventive concept, cooling as well as heating function energy is generated and stored during off-peak hours so as to be available during on-peak hours, when the compressors are deactivated in order to save electrical power. In FIG. 2 the ice maker and storage means is the sole source for cooling during the on-peak hours. In FIG. 6 both the air conditioner chilled water storage and ice maker and storage means ice water are the source for cooling during the on-peak hours.

When the charging coils C are employed, excess compressor cooling capacity is obtained during off-peak and is advantageously stored in a tank from which it is later withdrawn. It is an object and feature of this invention that this function be cooperatively combined with the ice maker and storage means in a common pipe system, characteristically in a series arrangement (see FIG. 7). When conditioned air is recirculated as shown in FIG. 8, the cold air passing through charging coils C chills the circulation of liquid through the storage tank therefor and through the ice maker and storage means in series therewith.

It is an object of this invention to provide control means by which the compressor to any one and all of the refrigeration air conditioners and the ice maker and storae means are deactivated and removed from service during on-peak hours and placed into service only during off-peak hours. In practice, there can be a control means that governs all compressor units, and to activate pump means of the pipe service systems, as may be required. That is, circulation of heat transfer liquid is required through the pipe systems when heat or cold is to be delivered from any one or all of the air conditioning units. It is to be understood that each refrigeration air conditioner unit is individually controlled by zone temperature controls, as well as by internal temperature controls, to deliver the desired conditioned air to the zone which they serve.

It is an object of this invention to provide a Multi-Zone Off-Peak Storage and On-Peak Energy Saving Air Conditioning System that is integrated with Automatic Fire Sprinker Systems. The support system herein disclosed provides the pipe systems required for the installation of said auto fire sprinklers, preferably in combination with tempered water storage as shown in FIG. 3, and as they are individually associated with each refrigeration air conditioner and zone serviced thereby as shown in FIG. 7.

SUMMARY OF THE INVENTION

The air conditioning systems disclosed herein advantageously employ any one or all of the presently available conventional type refrigeration air conditioners of the type hereinabove described. A feature of these air conditioners is that they can be supplied with a wet economizer air cooling coil R for cooling during electrical power on peak hours, during which time period the compressors of the air conditioners are deactivated. In order to perform in this manner, cold water is stored during off-peak hours when electrical power is readily available at lower cost rates. A feature of this air conditioning system is that the air conditioner compressors are downsized for lower cost installation as well as operational economy, the heat of compression being collected from the multiplicity of condensers and stored for heating use during on-peak hours.

As shown by the graph of FIG. 2, only the ice maker and storage means is employed to supply ice water cooling during on-peak hours, while the separate heating circuit related thereto through the condensers coils B1 conserve the heat of compression therefrom; from both the air conditioner condensers and from the ice maker and storage means condenser. Excess heat is removed by a cooling tower, while insufficient heat is made up by a boiler or by air conditioner heaters.

As shown by the graph of FIG. 6, either or both the air conditioner and ice maker and storage means are employed to supply cold water cooling during on peak hours, while the separate 55°–90° F. pipe circuits thereto through the condenser coils B1 conserve the heat of compression; from the air conditioner condensers. Additionally however, the FIG. 7 concept involves Variable Air Volume recirculation and chilled water from the charging coils C, and the inclusion of a cold water storage tank for chilled water in series with the ice maker and ice water storage means. Variable air volume is accomplished by means of a variable speed blower, or by means of a by-pass duct and air volume damper as shown. The cold water system is characterized by a valve that switches chilled water circulation directly or through the ice maker and storage means, and each air conditioner unit affected has such a valve arrangement. This central support system for heating and cooling with the employment of any one or all of the four aforementioned types of air conditioners, whether or not Variable Air Volume ducted, involves a 36°–68° F. pipe system for cooling and a pipe 55°–90° F. system for tempering; with the incorporation therein of auto fire sprinklers. A feature is that the number of air conditioners can be augmented or diminished and changes as to type at any time and as circumstances require, all without adverse effect upon the common support system of adequate capacity for the whole.

The foregoing and various objects and features of this invention will be apparent and fully understood from the following detailed description of the typical preferred forms and applications thereof, throughout which description reference is made to the accompanying drawings.

THE DRAWINGS

PREFERRED EMBODIMENT

Figure 1:
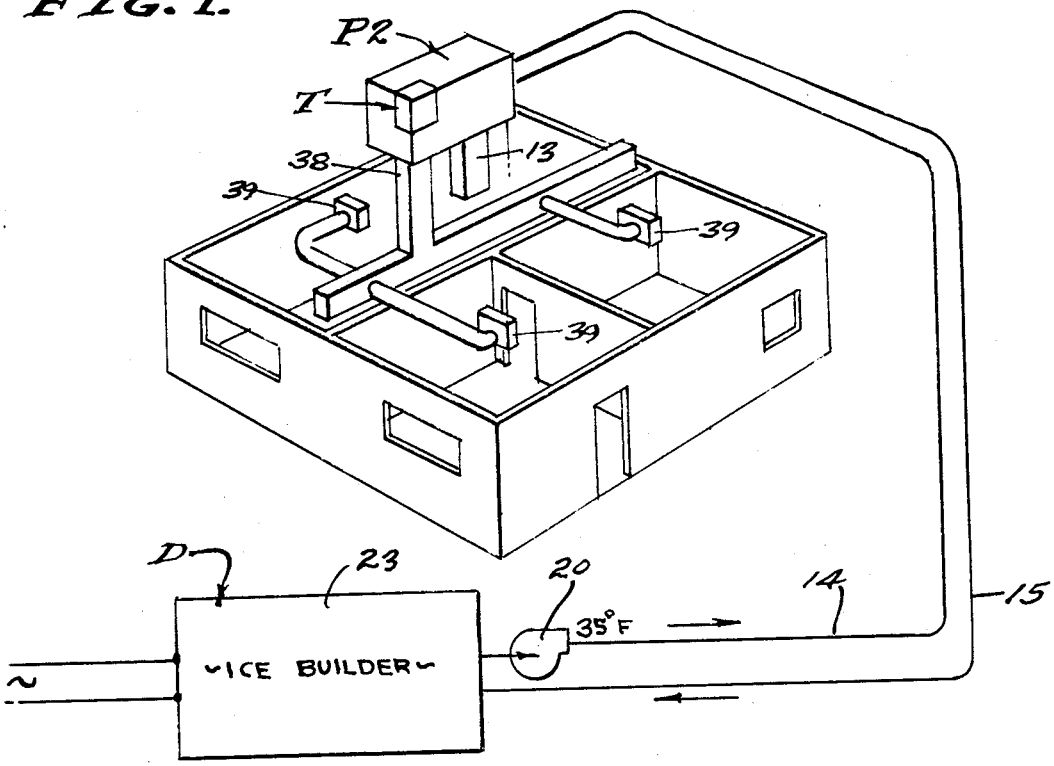
FIG. 1 is a view of one air conditioner and the zone space serviced thereby, as related to an ice maker and storage means.

Referring now to the drawings, this invention provides Multi-Zone Off-Peak Storage On-Peak Energy Saving Air Conditioning that features downsized air conditioners of any one or more different types combined with a support system to conserve as well as to supplement their operation. Each air conditioner is assigned to a building zone to be conditioned thereby, to either cool or to heat, or both to cool and heat, and each of the mechanical refrigeration type having a compressor followed by a condenser and an air handling coil. The support system is combined with a multiplicity of said air conditioners to store excess heat and/or cold generated thereby during off-peak electrical power periods, to be subsequently used during on-peak electrical power periods. Since the air conditioners are downsized, the support system is provided with cold water generating means for cooling the building zone air, and with water tempering means for heating the building zone air. The cold water generating means is preferably an ice maker and storage means D which makes ice that is stored with water to produce ice water for distribution to the air conditioners for building zone cooling. The water tempering means E includes a boiler 36, gas fired or the like, which makes tempered water that is then distributed to the air conditioners for building zone heating. A characteristic feature of each air conditioner is the inclusion therein of a wet economizer air cooling coil R in a common closed cold water and tempered water circuit. The compressors of the multiplifity of air conditioners are operated during the off-peak electrical power periods and are deactivated during the on-peak electrical power periods, as by control means T.

Figure 11:
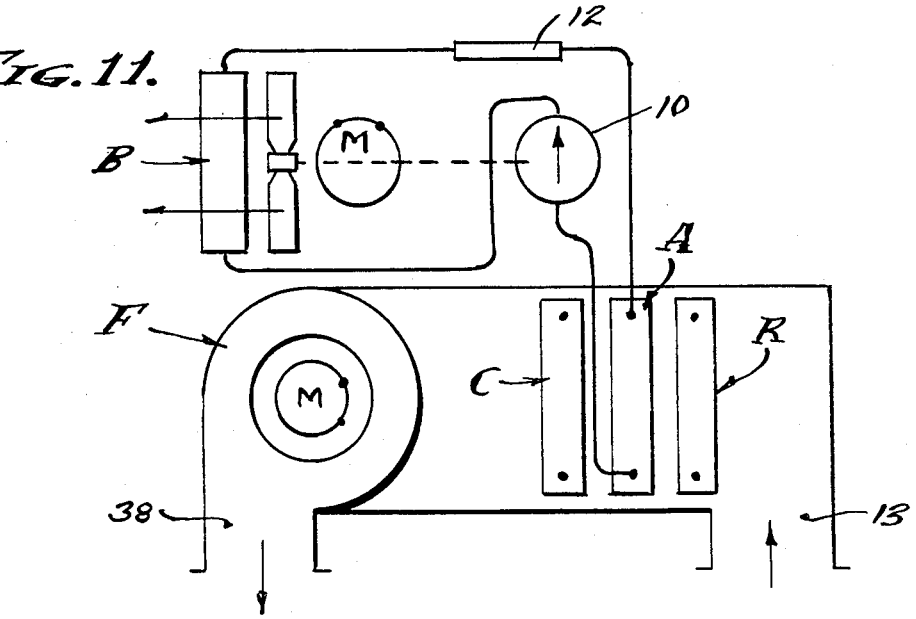

Referring to FIG. 11 of the drawings, a basic air source refrigeration air conditioner R1 is shown and which includes the following components and operates as follows: There is a compressor 10 operated by a motor M to direct the flow of hot refrigerant through a condenser coil B so that the heat of compression is dissipated to atmosphere by means of a fan 11 driven by the motor. The liquid refrigerant is then directed through an expansion device such as a capillary tube 12, and expands through an air handling evaporator coil A as a low pressure liquid. This low pressure liquid boils, becomes a vapor and absorbs heat from the supply air circulated through said coil A by means of a blower F. The refrigerant is then returned into the compressor 10 completing the refrigeration cycle. In accordance with this invention, the refrigerant air conditioner R1 includes a wet economozer air cooling coil R upstream of the air handling coil A in the intake air duct 13, and it may also include a charging coil C downstream thereof. Coils R and C are piped and valved as will be described with respect to FIGS. 12 and 13.

Figure 10:
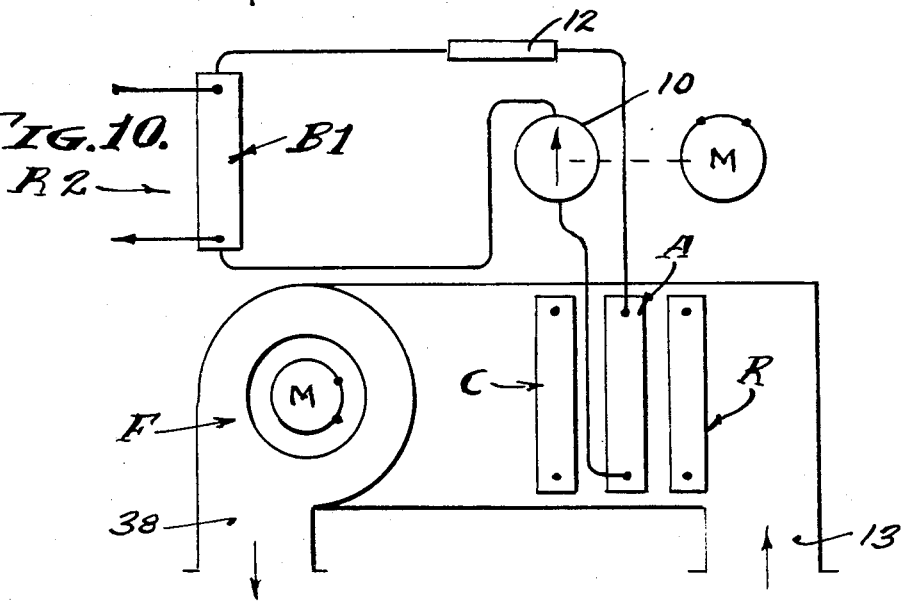

Referring to FIG. 10 of the drawings, a water source refrigeration air conditioner R2 is shown and which is the same as conditioner R1, except that the condenser coil B1 is a liquid to liquid heat exchanger that dissipates the heat of compression into a tempered water support system.

Figure 9:
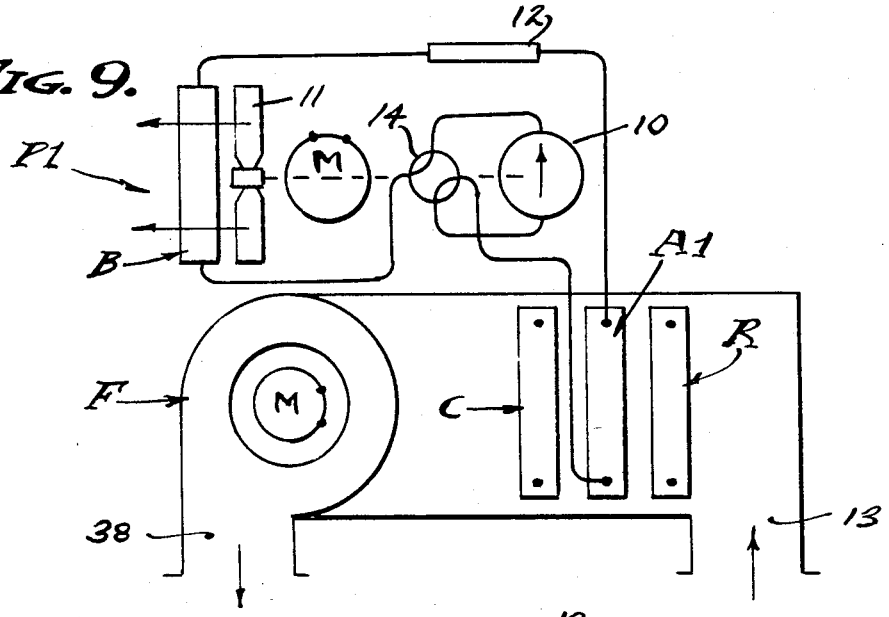
FIGS. 9, 10 and 11 are detailed schematic view of various types of air conditioners, FIG. 9 being that of an air source heat pump unit, FIG. 10 being that of a water source air refrigeration unit, and FIG. 11 being that of an air source refrigeration unit; each with both wet economizer air cooling coils and charging coils.

Referring to FIG. 9 of the drawings, an air source heat pump air conditioner P1 is shown and which includes the following components and operates as follows: There is the compressor 10 operated by the motor M and a valve 14 to reversely direct the flow of refrigerant through coil B that operates either as a condenser or an evaporator so that heat exchange is to atmosphere by means of the fan 11 driven by motor M. The liquid refrigerant is reversely directed through the expansion device or capillary 12 and through the air handling coil A1 operating as either an evaporator or as a condenser so that heat exchange is to the supply air flowing through coil A1 by means of the blower F. In accordance with this invention, the refrigeration air conditioner P1 may include a wet economizer air cooling coil R upstream of the air handling coil A in the intake air duct 13, and it may also include a charging coil C downstream thereof. Coils R and C are piped and valved as will be described with respect to FIGS. 12 and 13.

Figures 3, 4:
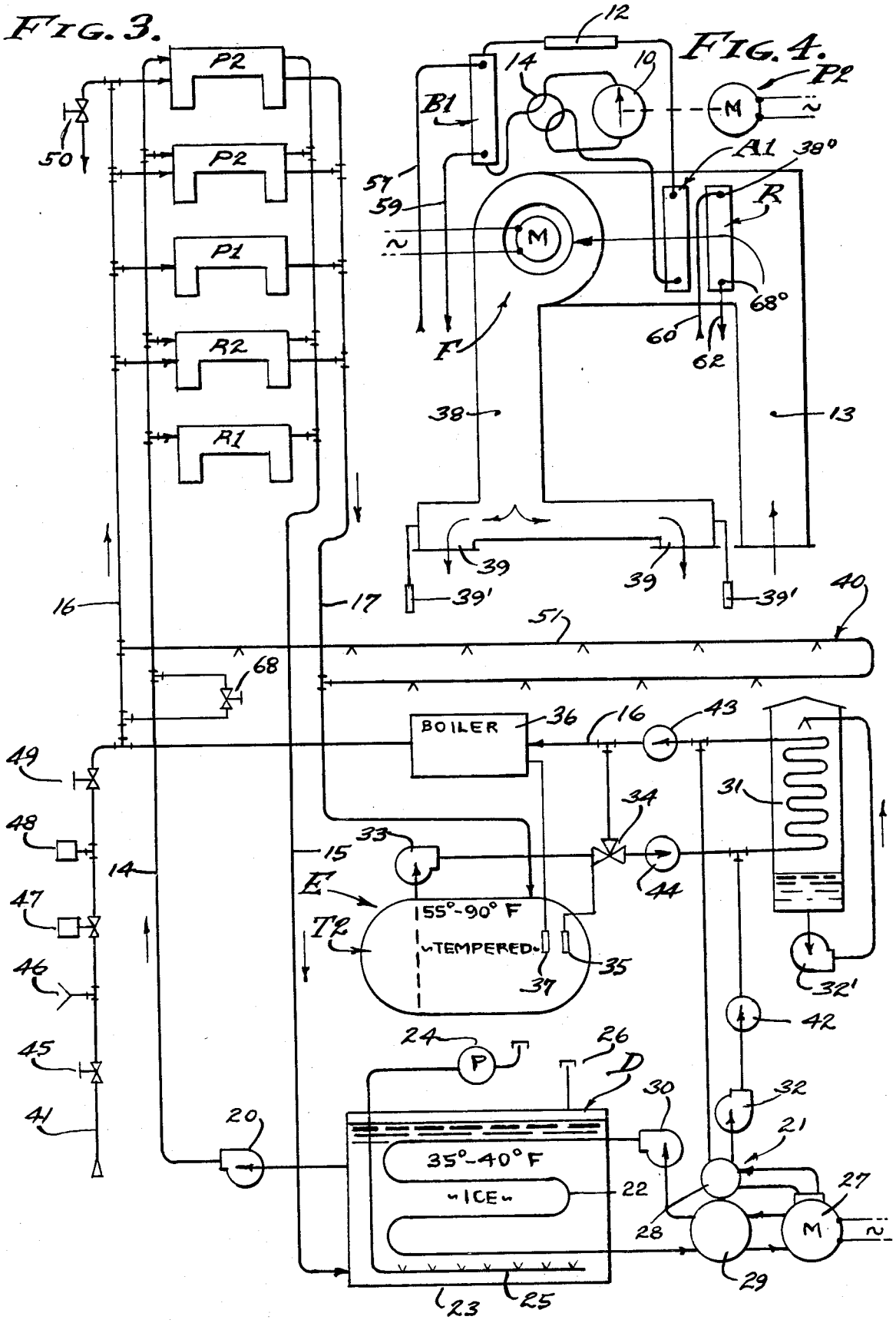
FIG. 3 is a schematic diagram of a multiplicity of air conditioners and the support system therefor, following the operation thereof as shown in FIG. 2.
FIG. 4 is a detailed schematic of an air conditioner in the form of a water source heat pump with a wet economizer air cooling coi.
Figure 5:
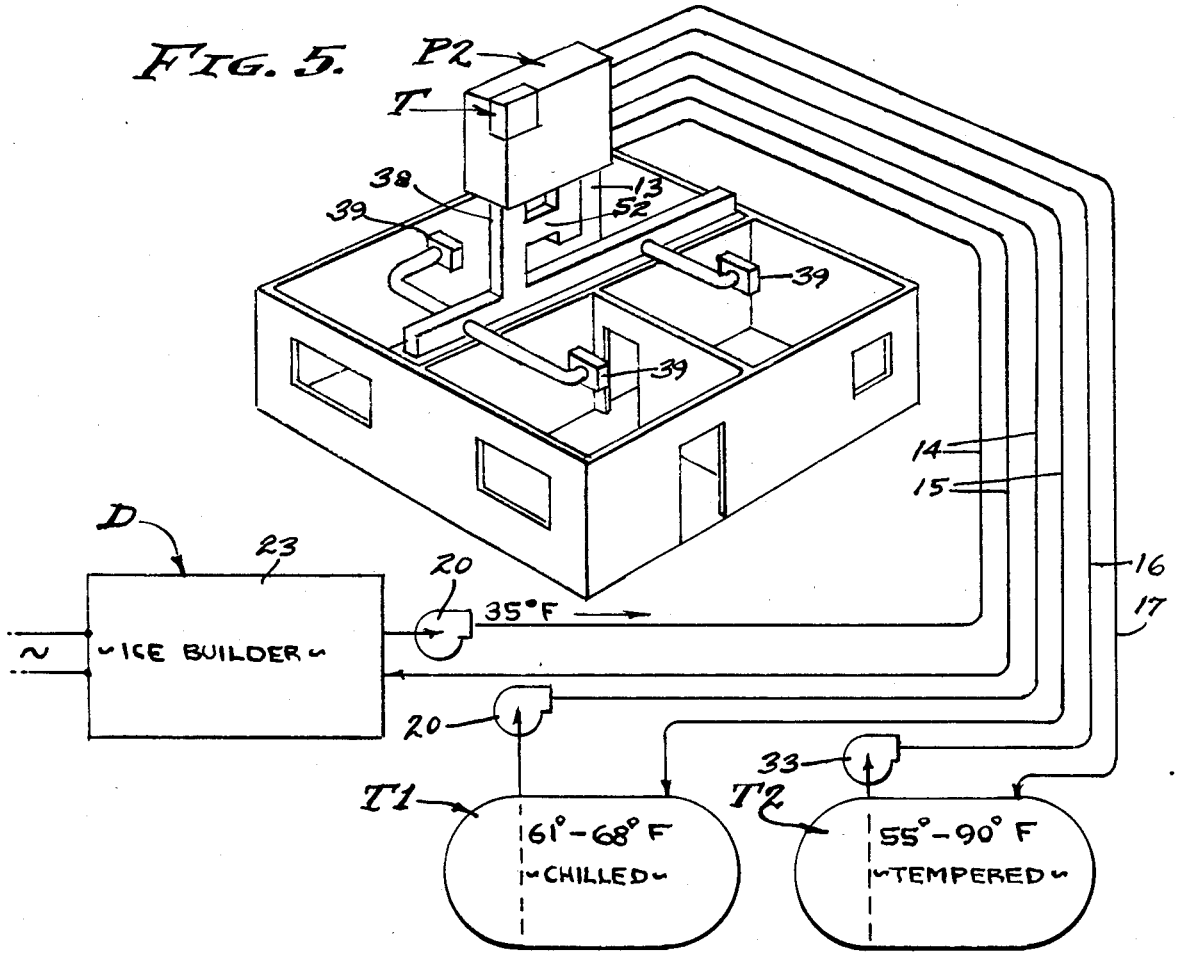
FIG. 5 is a second embodiment view of one air conditioner and the zone space serviced thereby, as related to air conditioner chilled water storage and ice maker ice water storage.
Figures 7, 8:
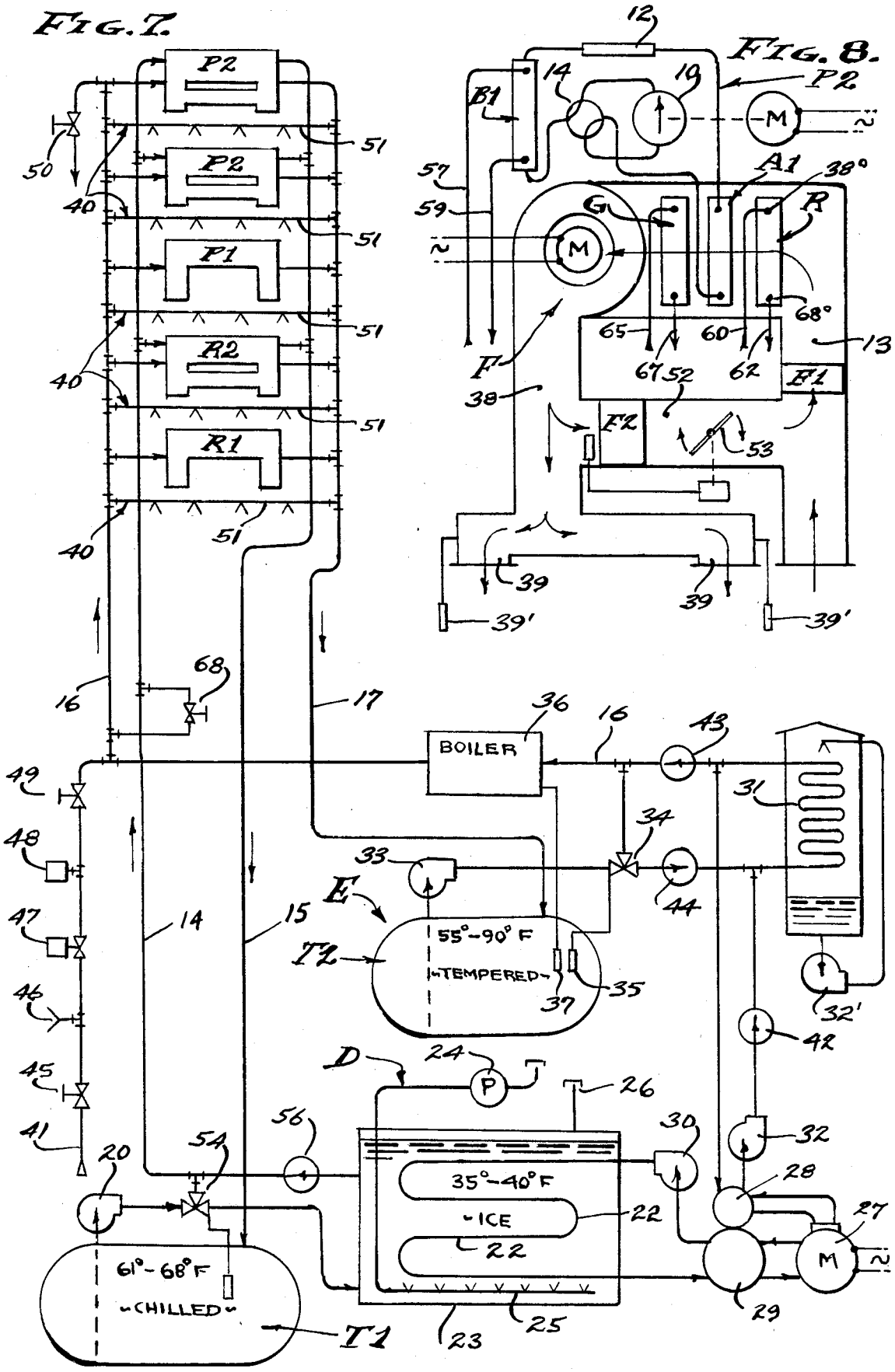
FIG. 7 is a schematic diagram of the second embodiment showing a multiplicity of air conditioners and the support system therefor, following the operation thereof as shown in FIG. 6.
FIG. 8 is a detailed schematic view of an air conditioner in the form of a water source heat pump with variable air volume ducting and with both a wet economizer air cooling coil and a charging coi.

Referring to FIGS. 4 and 8 of the drawings, a water source heat pump air conditioner P2 is shown and which is the same as air conditioner P1, except that the coil B1 is a liquid to liquid heat exchanger that dissipates the heat exchange into the tempered water circuit of the support system.

The above described four types of air conditioners are employed herein in either of two ways; (1) as a Constant Sir Volume Unit as shown in FIG. 4 wherein the intake sypply air is conditioned and directly returned to the building zone, and (2) as a Variable Air Volume Unit as shown in FIG. 8 wherein the intake supply air is recirculated with all or a part thereof returned to the building zone. Consequently, there are at least eight installation variations that may be employed herein, and additional variations thereto dependent upon the use of the coil C.

Referring now to the first embodiment of FIGS. 1–4 of the drawings, the support system involves the ice maker and storage means D in a pipe circuit comprised of a supply pipe 14 and a return pipe 15, and the water tempering means and storage means E in a pipe circuit comprised of a supply pipe 16 and a return pipe 17. For purpose of example, a multiplicity of air conditioners is shown in FIG. 3, an air source refrigeration air conditioner R1, a water source refrigeration air conditioner R2, an air source heat pump air conditioner P1, and two water source heat pump air conditioners P2.

The two pipes 14 and 15 of the means D are connected through the wet economizer air cooling coil R of each of said air conditioners, and the two pipes 16 and 17 of the means E are connected through the condenser or heat exchanger coils B1 of the air conditioners (see FIGS. 3 and 4). Alternately, the two pipes 16 and 17 of the means E (see FIG. 7) are connected through the re-cooling coil R of each air conditioner. And, it is to be understood that the two pipes 16 and 17 are connected to both the water source air conditioner coils B1 or R.

Figure 2:
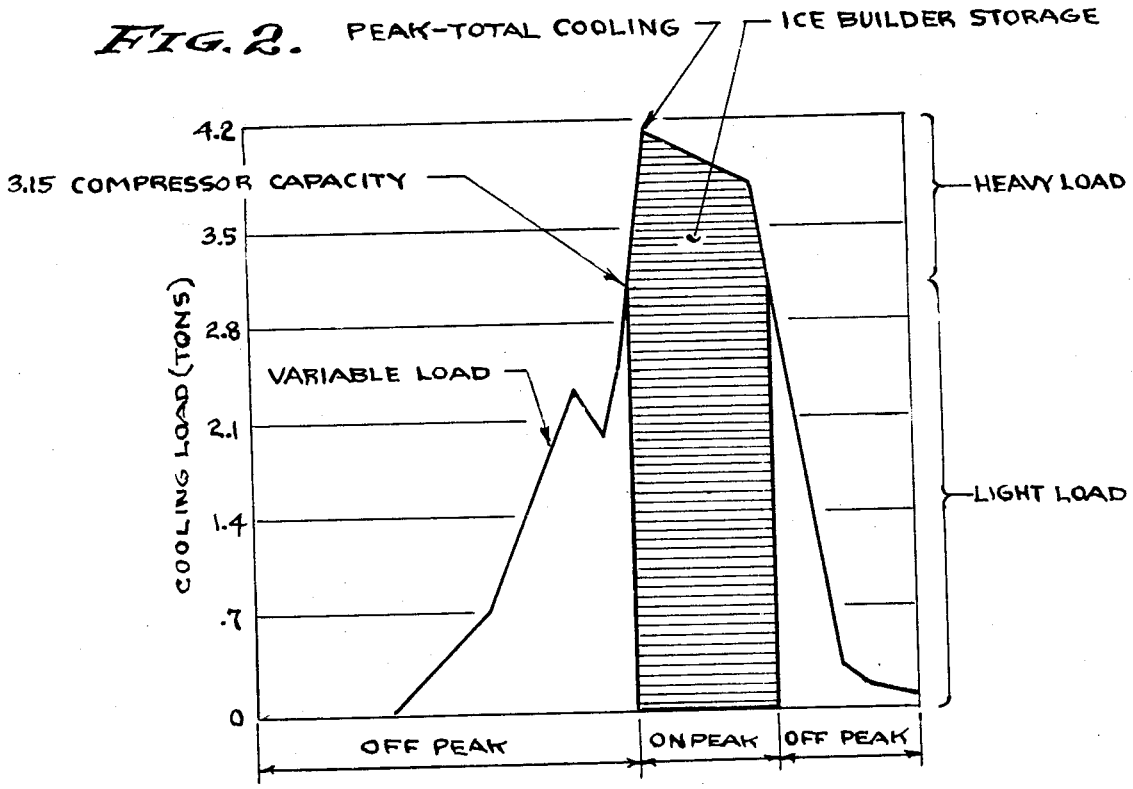
FIG. 2 is an operational graph illustrating the compressor load related to off-peak and on-peak operation and the user of ice builder storage.

The ice maker and storage means D is in series in the cold water pipe circuit 14–15, there being a pump 20 controlled by the control means to deliver ice water therefrom and to the air conditioners at approximately 36° F. during off-peak electrical power periods, in accordance with the graph of FIG. 2. The means D is an ice machine that involves refrigeration means 21 that circulates refrigerant such as Freon through ice forming coils 22 within a tank-reservoir 23. There is an air pump 24 and bubble tube 25 to percolate air through the iced water in order to improve ice formation around the coils 22 within said reservoir, there being a vent therefor at 26.

The refrigeration means 21 is shown as a compressor 27 and a condenser 28 and a chiller 29, through which the heat transfer liquid is circulated through coils 22 by a pump 30. The condenser 28 is a liquid to liquid heat exchanger from which the heat of compression is dissipated through a closed circuit cooling tower means having coils 31. A pump 32 circulates the evaporatively colled tower water under thermostat control in a conventional manner with condition sensing means (not shown). Likewise, the refrigeration means 21 is under thermostat control in a conventional manner with condition sensing means related to the ice storage (not shown).

The water tempering and storage means E is in the pipe circuit 16–17, there being a pump 33 controlled by the control means T to deliver water therefrom and to the air conditioners at approximately 55° to 90° F. The means E involves the heat exchanger coils B1 of the water source air conditioners R2 and P2, and a tempered water storage tank T2 in the closed circuit of pipes 16 and 17, the pump 33 circulating tempered water therethrough. Excess heat in the tempered water circuit is dissipated through the cooling tower coils 31, and recirculated through pipes 16 and 17. When cooling is not required, a valve 34 is operated by a temperature control 35 in the storage tank T2 to bypass the cooling tower coils 31 and directly recirculate it through the pipes 16 and 17. When the temperature is down in the storage tank T2 a boiler 36 in the supply pipe 16 heats the water as may be required, under temperature control 37 in tank T2.

The air conditioners in the first embodiment above described are constant air volume units as clearly shown in FIG. 4 of the drawings. That is, the intake air enters through duct 13 and passes through the air handling coil A and is discharged from return air duct 38. As shown, there are dampers 39 that are modulated by zone space thermostats 39' to control air temperature. Each of the air conditioners shown in FIG. 3 has the wet economizer air cooling coil R as shown in FIG. 4. Operation of the first embodiment is illustrated by the graph of FIG. 2, showing that the load on the compressors can be variable and that they are deactivated during the on-peak electrical power period. The air conditioner compressors 10 are operated during off-peak electrical power periods, and so too is the ice machine compressor of means D, which has a capacity to satisfy the ice water storage requirement to supply the peak-total cooling requirement that is above or higher than the compressor capacity, all as shown by the graph. Accordingly, the individual air conditioners satisfy the light loads of air conditioning while the storage of ice satisfies the heavy load when the air conditioner compressors are deactivated. A feature is that any one or more malfunctioning air conditioner can draw from the cold water reverse storage or the tempered water reverse storage of the support system, as shown and described.

Automatic fire sprinkler system 40 is shown as it is applied to large rate of flow pipes 16 and 17, with the required fire equipment installed in the water main 41 that supplies the support system. Therefore, the automatic fire sprinkler system 40 is incorporated into the tempered water and storage means E as shown in FIG. 3. The means E has protective check valves to separate the cooling of condenser 28 from the hot water supply; a check valve 42 in the pipe from the condenser to the cooling tower coil which also receives water from tank T2, a check valve 43 in the pipe from the tower coil to the boiler 36 which also receisve water from tank T2, and a check valve 44 in the pipe from tank T2 to the cooling tower coil. In order to implement the support system and the multiplicity of air conditioners combined therewith, water is supplied thereto by the water main 41 through an outside stem and yoke valve 45, and then through a series of required valves etc. as follows: Following valve 45 there is a Fire Department connection 46. Following connection 46 there is a main alarm valve 47. Following valve 47 there is a flow switch 48. And, following switch 48 there is a main drain and inspector's test valve 49 that opens into the supply pipe 16. Remove from the main 41 water supply there is a flush and inspector's test valve 50 that opens from the supply pipe 16. As shown, the supply pipe 16 supplies the sprinkler system pipe 51 which then opens into return pipe 17. The pipe 51 is installed so as to have neutral convection flow due to heat loss therein, and so as to be continuously purged and ready for any emergency operation.

Referring now to the second embodiment of FIGS. 5-8 of the drawings, both Constant Air Volume and Variable Air Volume air conditioners are employed, some of which are Air Source and some of which are Water Source. This second embodiment is the same as the first described embodiment except as follows: Each air conditioner serves an area of separated zones, and is combined with an automatic fire sprinkler system 40 in parallel therewith, each air conditioner being equipped with a wet economizer air cooling coil R; namely an air conditioning coil that passes chilled 61°-68° F. water and/or 35°-40° F. ice water (or both together), or which passes evaporatively cooled 61°-68° F. tower water, or which passes stored 55°-90° F. water whether or not tempered by the boiler 36. The variable air volume conditioner employed in this second embodiment includes a by-pass duct 52 through which air is recirculated in response to a variable air volume control means 53. The by-pass duct 52 is provided to recirculate blower air from the supply air duct 38 and into the air intake duct 13, proportionately as is required according to the restriction imposed by zone space dampers. There are a number of ways in which zone space air volume can be varied by the control means 53; one way is to provide an air intake duct (13) damper means, which in practice is a state of the art vortex damper means at the inlet of blower means F; another way is to provide a supply air duct (38) damper means 39; or the blower means F motor M can be regulated by a speed control means. As shown, the zone space dampers 39 partially or completely restrict the supply air flow into the air conditioner, according to control by the space thermostats that modulate the dampers 39 between opened and closed positions. The dampers 30 are modulated dependent upon space temperature requirements. A pressure responsive means 53' is provided to sense the air pressure in supply air duct 38 and thereby commensurately controls a by-pass damper control means 53 as above stated. Accordingly, control means 53 is responsive to air flow restriction or regulation through the air conditioner and regulates circulation, and a most effective and preferred form thereof involves the run-around recirculation through by-pass duct 52, as shown and described. The space thermostats 39' will also determine the position of the refrigerant direction valve 14, so that on a net call for heating the air handling coil A-A1 is switched to the heating mode, and visa versa on a net call for cooling.

A utilitarian feature of the second embodiment is the inclusion therein of the charging coil C which is advantageously placed downstream of the air handling coil A or A1, as the case may be. When the air conditioner is in the cooling mode, water circulation through charging coil C can be chilled and delivered to cold water storage tank T1 for storage at 61°-68° F., and from which it is circulated by pump 20 through the ice maker and storage means D, as above described. Although the series flow of chilled water of tank T1 is through the ice water storage tank 23, said chilled water can be bypassed by a switching valve 54 that recirculates the chilled water directly into supply pipe 14 when the temperature thereof is adequately down in tank T 1, as sensed by temperature control 55. However, when the temperature rises in tank T1 the ice water of tank 23 supplements the cooling requirement as determined by the control 55. A check valve 56 in pipe 14 prevents back flow through the ice maker and storage means D. Accordingly, chilled water storage can be supplied directly from tank T1 and into supply pipe 14, or it can be supplied through the ice water storage tank 23.

Figure 6:
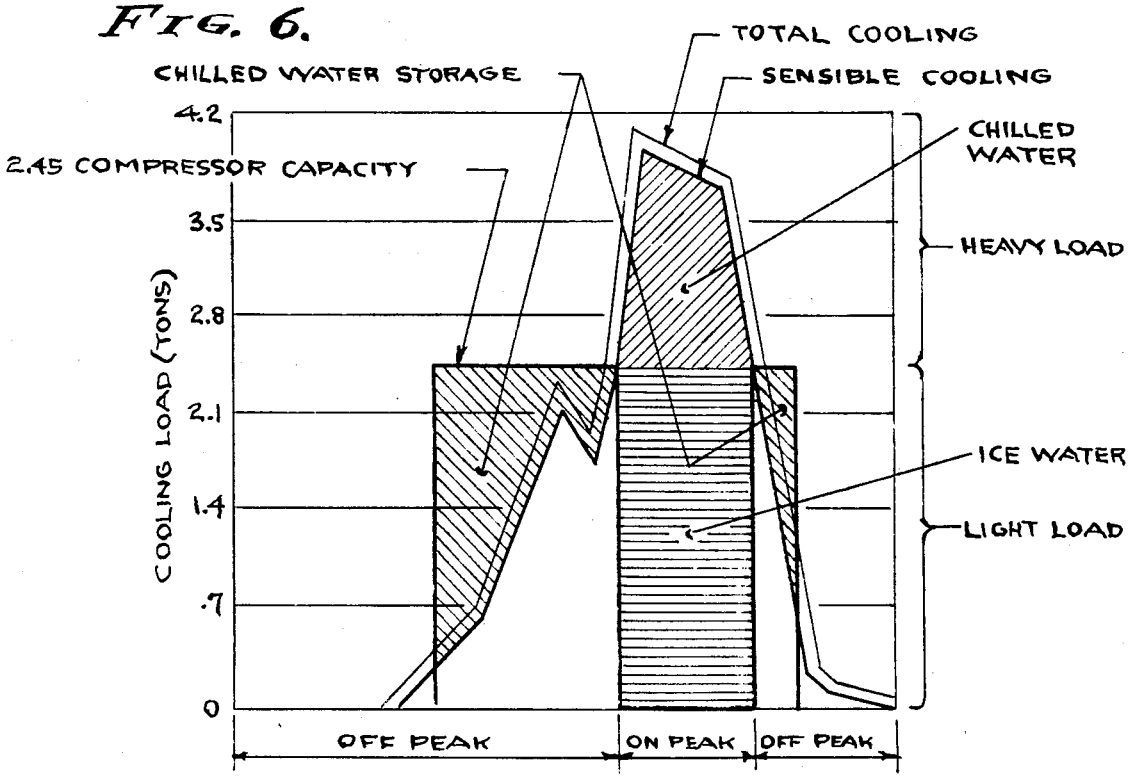
FIG. 6 is an operational graph illustrating the second embodiment of FIG. 5 and the compressor load related to off-peak and on-peak operation and the use of chilled water storage as well as ice water storage.

Operation of the second embodiment is illustrated by the graph of FIG. 6, showing that the load on the compressors can be variable and that they are deactivated during the on-peak electrical power period. The air conditioner compressors 10 are operated during the off-peak electrical periods, and so too is the ice machine compressor of means D, which together have a capacity to satisfy the chilled water and ice water storage requirement to supply the peak-total cooling requirement that is above or higher than the compressor capacities, all as shown by the graph. Accordingly, the individual air conditioners satisfy the light loads of air conditioning while the storage of chilled water and ice satisfies the heavy load requirements when the air conditioner and ice machine compressors are deactivated. A features is that the use of stored chilled water or ice water is selective. Note that the chilled water storage supplements the ice or ice water storage, as shown by the graph, in order to satisfy total cooling during on peak periods.

Figure 12:
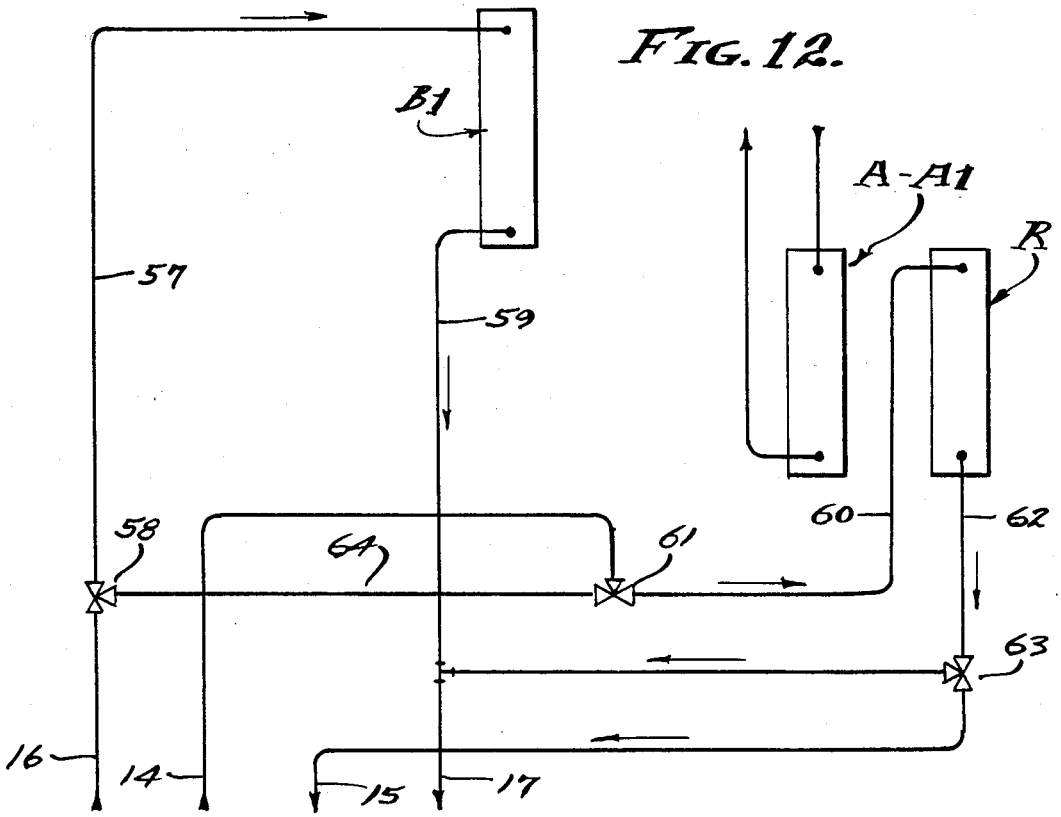
FIG. 12 is a detailed schematic of the preferred valving in the first embodiment of FIGS. 1–4.
Figure 13:
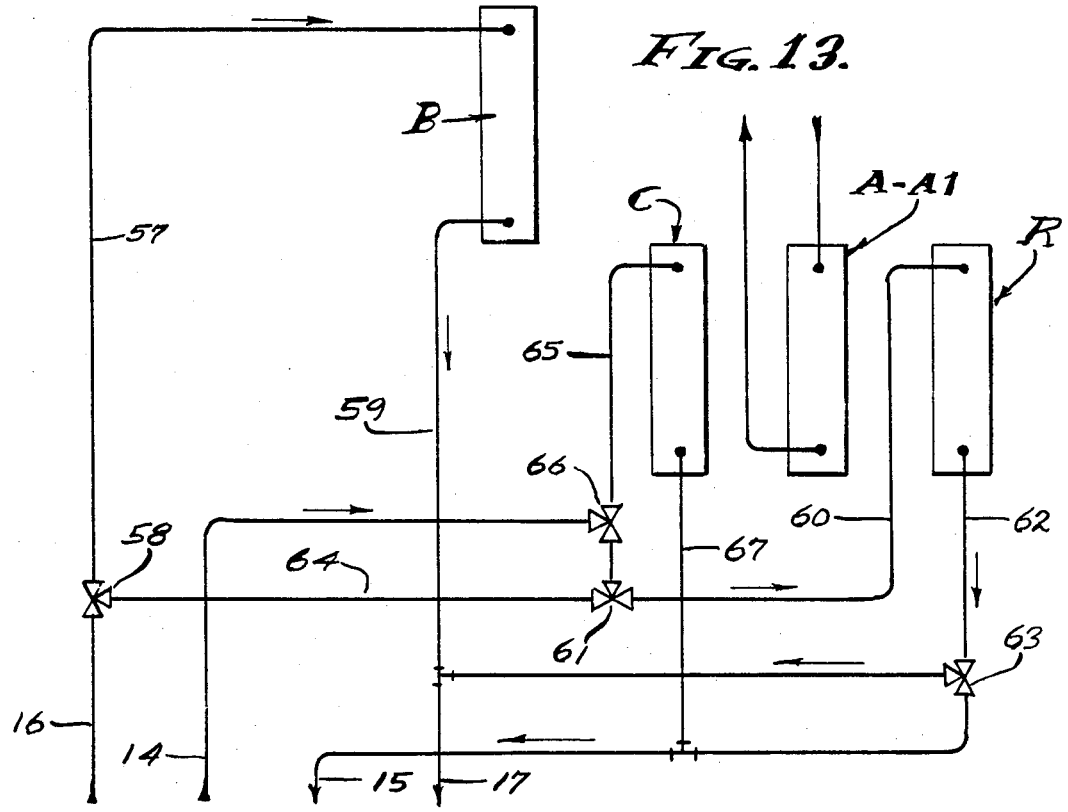
FIG. 13 is a detailed schematic of the preferred valving in the second embodiment of FIGS. 5–8.

Referring now to FIGS. 12 and 13 of the drawings, independent valve control of the air conditioners is shown. That is, each air conditioner R1, R2, P1 and P2, and any variations thereof, has its individual valve controls to regulate the operation of the air handling coil A or A1, the wet economizer air cooling coil R, the charging coil C, and the heat exchanger coil B1. FIG. 12 illustrates the coil and valve arrangement for the first embodiment of FIGS. 1–4, and FIG. 13 illustrates the coil and valve arrangement of the second embodiment of FIGS. 5–8. In each embodiment there is a closed pipe circuit 14–15 for circulating chilled water and/or ice water, and there is a closed pipe circuit 16–17 for circulating tempered water. The air handling coil A or A1 is piped as above described with respect to compressor 10 and switching valve 14.

The heat exchange coil B1 has an inlet pipe 57 extending from control valve 58 connected to supply pipe 16, and it has an outlet pipe 59 extending to and connected to return pipe 17.

The wet economizer air cooling coil R has an inlet pipe 60 extending from a control valve 61 alternately connected to inlet pipe 14 or 16, and it has an outlet pipe 62 extending to a control valve 63 alternately connected to outlet pipe 15 or 17.

Valves 58, 61 and 63 are switching valves, the valve 58 being connected to a pipe 64 through valve 61 and to pipe 60 into coil R. When valve 58 closes to pipe 57 and switches to pipe 64, the refrigeration pump 10 is turned off.

In order to absorb the heat of compression from the heat exchanger coil B1 in the cooling mode, or to remove cold therefrom in the heating mode, the valve 58 is opened to pipe 57 and closed to pipe 64, whereby water circulation is through coil B1 and through the tempered water and storage means E.

In order to circulate stored tempered or cooling tower water through the wet economizer air cooling coil R, the valve 58 is closed to pipe 57 and opened to pipe 64 and through valve 61 to the inlet pipe 60 to coil R, whereby water circulation is from the storage tank T2 or cooling tower coil 31 of means E, dependent upon the position of the switching valve 34.

In order to circulate stored chilled water or stored ice water through the wet economizer air cooling coil R, the valve 61 is closed to pipe 64 and opened to pipe 60 from inlet pipe 14, whereby water circulation is from the storage tank T1 or storage tank 23 of means E, dependent upon the position of switching valve 54, and valve 63 is closed to pipe 17 and opened to return pipe 15 for return to means E.

Referring specifically to FIG. 13 and the second embodiment, there is the charging coil C that has an inlet pipe 65 extending from a control valve 66 connected to inlet pipe 14 and alternately to the switching valve 61, and that has an outlet pipe 67 connected to the outlet pipe 15. In order to absorb cold from the charging coil C in the cooling mode, the valve 66 is opened to pipe 65 from the inlet pipe 14, and is open through pipe 67 to return pipe 15, whereby water circulation is through the coil C and through the cold stroage tank T1 or through both the storage tank T1 and the ice maker and storage means D, as controlled by the switching valve 54.

As hereinabove described, the aforesaid positioning of valves 58, 61, 63 and 66 is by control means T and in response to the air conditioner mode of operation, either the cooling or heating mode of operation, and all of which depends upon space temperature requirements within the building space zones being air conditioned.

Note that the heat exchange coil B1 heats the 55°–90° F. tempered water storage in tank T2 when the air conditioner is in the cooling mode, whereas is cools that water source when in the heating mode. The auxilliary water boiler 36 and the coolint tower coil 31 compensate as required to maintain the temperated water temperature within the preferred range of 55° to 90° F.

The conditioned air circulated through the charging coil C it normally in the range of 42° to 56° F. and absorbs heat from the chilled water source pumped therethrough, so that the chilled water storage tank T1 is maintained within said useful 61° to 68° F. range.

Referring now to air quality, in addition to the usual air filter in the intake duct 13, there is also an air filter in the air recirculation by-pass duct 52 of the second embodiment heat pumps. As shown, there is the primary air filter F1 in the air intake duct 13 following the commingling therein of the recirculation air, and there is a secondary air filter F2 in the by-pass duct 52, preferably ahead of the air volume damper means 53. Said placement of the primary and secondary filters F1 and F2 is significant, making it advantageous to place the more effective primary filter F1 for its full time processing of air, while the lessor effective secondary filter F2 is of a capacity for processing the reduced volume of recycled air. In practice, the pressure senser 53' is placed ahead of the secondary filter F2 in order to sense variable pressure in the ducts 13 and 38, to control the variable volume damper means 53.

This air conditioning system uses off-peak electrical power to generate and to store both tempered and cold water. A multiplicity of air conditioners of the mechanical refrigeration type are supported by a common support system, regardless of their varied configurations. However, a characteristic feature of these air conditioners is the inclusion therein of the wet economizer air cooling coil R, this coil being employed to heat or cool conditioning air from liquid and/or ice storage and from cooling tower liquid. Anothe characteristic features is the charging coil C that chills water from any excess cooling of conditioning air from the air handling coil A or Al. In the first embodiment of FIGS. 1–4, the air conditioners are cycled on and off according to their zone requirements for heating or cooling, the ice machine of means D being operated as required during off-peak electrical periods. In the second embodiment of FIGS. 5–8, the air conditioners are operated continuously during off-peak electrical periods in order to generate as much chilled water as possible, to be supplemented by the ice machine of means D operated as required to reach a desired capactity during said off-peak electrical periods. The varied types of air conditioners are integrated with the common support system therefor, whereby the combination is complementary and provides sharing of chilled water, ice water and tempered water, and also the cooling tower water that contributes to both heating and cooling as circumstances require. Also, an advantage is attained with the water tempering means E and its pipe system which is in reality an extension of the automatic fire sprinkler system 40, whereby the two pipes 16 and 17 serve multiple purposes while meeting the full functional requirements of heating or cooling and of fire safety, depending upon whether the air conditioner served is for refrigeration only or is a heat pump. As shown, the two pipe system 14–15 can be charged with water from the water main 41 and pipe 16 through a valve 68.

During the summer and warmer periods, space conditioning demand is predominantly for cooling though some heating may be required. Accordingly, air conditioners with charing coils C transfer chilled water through cold storage tank T1, most efficiently by the variable air volume units, and this storage is supplemented by the ice formation and ice water storage in vessel 23. The chilled water use from tank T1 has priority use through switching valve 54, followed by the use of ice water from vessel 23. Tempered water in storage tank T2 is available for heating through coil R, as may be required. There is also the source of cooling tower water for heating, since it is inherently tempered during warmer periods.

During the winter and cooler periods, the conditioning demand is predominantly for heating, though some cooling may be required. Accordingly, the heat pump air conditioners with reversible heat transfer coils A (A1) and B (B1) are employed for direct heating. The tempered water use from tank T2 has priority use through switching valve 34, followed by use of tower water, the boiler 36 maintaining 55° to 60° F. tempered water. And the zone spaced with nonheating air conditoners are provided with state of the art furnaces, either separate or intergral therewith, the cooling tower water being inherently cold during cooler periods.

Heat transfer through the common support system to the individual air conditioners is entirely by water piping integrated with the automatic fire sprinkler system supplied by the Utility main. And, air ducting is restricted to each air conditioner and its zone spaces. Full and partial demand limiting applications are possible with the hereinabove described air conditioning systems. A full demand limited air conditioning system is disclosed herein, as clearly shown in FIGS. 2 and 6. However, it is to be understood that the systems disclosed can also be partial demand limited if so desired, in order to cope with abnormal situations and in order to be cost effective in certain situations. The full demand limiting approach provides the maximum amount of displaced electrical demand, and it will be understood that should one elect to reduce the capacity of the ice maker and ice storage means as shown and described, one may elect to have all or some of the down sized air conditioner compressors operated on peak, so that the air conditioner cooling capacity for its zone requirement is provided by the combined refrigeration capacity supplemented by ice water circulation, as described. Under these circumstances, the installation becomes a partial demand limiting system wherein associated auxiliaries are required to operate during the on peak periods, which could prove to be most cost effective under some conditions, depending upon Utility costs during on-peak, off-peak and mid-peak periods, as may be appropriate. Adaptation and diversification are inherent attributes of this air conditioning system as it is disclosed herein.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A multi-zone off-peak thermal storage and on-peak energy saving air conditioning system comprised of a multiplicity of air conditioners serving seprate zone spaces to be conditioned, and a common support system for said multiplicity of air conditioners;

each air conditioner comprising a powered refrigeration compressor directing refrigerant through a heat exchange coil and through an air handling coil, an air intake duct from its zone space and delivering air from the zone space and through the air handling coil, a supply air duct delivering conditioned air into the zone space from the air handling coil, and blower means delivering the air therethrough, each air conditioner having a wet economizer air cooling coil in the intake duct and with valve means to connect it alternately through a cooling circuit and through a tempering circuit, each air conditioner having a control means switching it into and out of a cooling mode, the common support system comprising an ice maker and ice water storage means circulating water through the cooling circuit, and a water tempering means circulating water through the tempering circuit, and control means activating the powered refrigeration compressors during off-peak power periods and deactivating the same during on-peak power periods.

2. The multi-zone common support air conditioning system as set forth in claim 1, wherein at least one of the air conditioners has an air source heat exhange coil and with its valve means connected only into the cooling circuit.

3. The multi-zone common support air conditioning system as set forth in claim 1, wherein at least one of the air conditioners has a water source heat exchange coil and with its valve means connected into both the tempering circuit and the cooling circuit.

4. The multi-zone common support air conditioning system as set forth in claim 1, wherein the ice maker and ice water storage means comprises a power refrigeration compressor directing refrigerant through an ice forming storage vessel, and a condenser dissipating heat from a cooling tower means, and wherein the control means activates the powered ice water storage means compressor during off-peak power periods and deactivates the same during on-peak power periods.

5. The multi-zone common support air conditioning system as set forth in claim 4, wherein the water tempering means includes a tempered water storage tank and the cooling tower means in series in the tempering circuit, and with pump means for circulating water therethrough.

6. The multi-zone common support air conditioning system as set forth in claim 4, wherein the water tempering means includes a tempered water storage tank and the cooling tower means in series in the tempering circuit, and with pump means for circulating water therethrough, and valve means therein by-passing the cooling tower means.

7. The multi-zone common support air conditioning system as set forth in claim 4, wherein the cooling tower means is in series with the tempering circuit.

8. The multi-zone common support air conditioning system as set forth in claim 1, wherein the water tempering means includes a tempered water storage tank in series in the tempering circuit, and with pump means for circulating tempered water therethrough.

9. The multi-zone common support air conditioning system as set forth in claim 1, wherein the water tempering means includes a tempered water storage tank in series in the tempering circuit, and with pump means for circulating tempered water at substantially 55° to 90° F. therethrough.

10. The multi-zone common support air conditioning system as set forth in claim 1, wherein the water tempering means includes a water boiler in series in the tempering circuit, and with pump means for circulating tempered water therethrough.

11. The multi-zone common support air conditioning system as set forth in claim 1, wherein the ice maker and ice water storage means includes pump means for circulating ice water at substantially 35° to 40 F. through the cooling circuit.

12. The multi-zone common support air conditioning system as set forth in claim 11, wherein the ice maker and ice water storage means includes a chilled water storage tank and an ice water storage vessel in series in the cooling means circuit, and with pump means for circulating water therethrough.

13. The multi-zone common support air conditioning system as set forth in claim 11, wherein the ice maker and ice water storage means includes a chilled water storage tank and an ice water storage vessel in series in the cooling circuit, and with pump means for circulating water therethrough, and valve means therein by-passing the ice storage vessel.

14. The multi-zone common support air conditioning system as set forth in claim 1, wherein the water tempering means includes a tempered water storage tank and a water boiler in series in the tempering circuit, and with pump means for circulating tempered water at substantially 55° to 90° F. therethrough.

15. The multi-zone common support air conditioning system as set forth in claim 4, wherein the water tempering means includes a tempered water storage tank and a water boiler in series in the tempering circuit, and with pump means for circulating tempering water at substantially 55° to 90° F. therethrough.

16. The multi-zone common support air conditioning system as set forth in claim 1, wherein the tempering circuit includes a supply pipe of an automatic sprinkler system having a pipe with sprinklers extending to a return pipe of the tempering circuit, the supply pipe thereof being connected into a Utility water supply main.

17. The multi-zone common support air conditioning system as set forth in claim 1, wherein the tempering circuit includes a supply pipe of an automatic sprinkler system having a pipe with sprinklers extending in parallel with at least one of the air conditioners and to a supply pipe and a return pipe of the tempering circuit, the supply pipe thereof being connected into a Utility water supply main.

18. The multi-zone common support air conditioning system as set forth in claim 1, wherein at least one of the air conditioners is of the Variable Air Volume type having a variable air volume control means circulating air therethrough in response to air flow restriction imposed by an intake duct damper means controlling return of zone space air.

19. The multi-zone common support air conditioning system as set forth in claim 1, wherein at least one of the air conditioners is of the Variable Air Volume type having a variable air volume control means circulating air therethrough in response to air flow restriction imposed by a supply duct damper means controlling delivery of zone space air.

20. The multi-zone common support air conditioning system as set forth in claim 1, wherein at least one of the air conditioners is of the Variable Air Volume type having a variable air volume control means circulating air therethrough in response the speed control means regulating air delivery by the blower means.

21. The multi-zone common support air conditioning system as set forth in claim 1, wherein at least one of the air conditioners is of the Variable Air Volume type having a by-pass air duct extending between the intake air duct and the supply air duct and with a variable air volume control means recirculating air therethrough in response to supply air restriction imposed by a zone space damper means controlling circulation of zone space air.

22. A multi-zone off-peak thermal storage and on peak energy saving air conditioning system comprised of a multiplicity of air conditioners serving separate zone spaces to be conditioned, and a common support system for said multiplicity of air conditioners;

each air conditioner comprising a powered refrigeration compressor directing refrigerant through a heat exchange coil and through an air handling coil, an air intake duct from its zone space and delivering air from the zone space and through the air handling coil, a supply air duct delivering conditioned air into the zone space from the air handling coil, and blower means delivering the air therethrough, and at least one of the air conditioners being a heat pump with a reversing valve means directing refrigerant in alternate directions through the heat exchange coil and through the air handling coil thereof, each air conditioner having a wet economizer air cooling coil in the intake duct and with valve means to open alternately through a cooling circuit and through a tempering circuit, each air conditioning having a control means alternately switching its valve means to a cooling mode and a heating mode, the common support system comprising an and ice maker and ice water storage means circulating water through the cooling circuit, and a water tempering means circulating water through the tempering circuit, and control means activating the powered refrigeration compressor during off-peak power periods and deactivating the same during on-peak power periods.

23. The multi-zone common support air conditioning system as set forth in claim 22, wherein the at least one air conditioner is an air source heat pump with air circulation through the heat exchange coil thereof.

24. The multi-zone common support air conditioning system as set forth in claim 22, wherein the at least one air conditioner is a water source heat pump with a liquid to liquid heat exchange coil connected by valve means into the tempering circuit.

25. The multi-zone common support air conditioning system as set forth in claim 22, wherein the ice maker and ice water storage means includes a power refrigeration compressor directing refrigerant through an ice forming storage vessel, and a condenser dissipating heat from cooling tower means, and wherein the control means activates the powered ice water storage means compressor during off peak power periods and deactivates the same during on-peak power periods.

26. The multi-zone common support air conditioning system as set forth in claim 25, wherein the cooling tower means is in series with the tempering circuit.

27. The multi-zone common support air conditioning system as set forth in claim 24, wherein the water tempering means includes a tempered water storage tank in series in the tempering circuit, and with pump means for circulating tempered water therethrough.

28. The multi-zone common support air conditioning system as set forth in claim 24, wherein the water tempering means includes a tempering water storage tank in series in the tempering circuit, and with pump means for circulating tempered water at substantially 55° to 90° F. therethrough.

29. The multi-zone common support air conditioning system as set forth in claim 24, wherein the water tempering means includes a water boiler in series in the tempering circuit, and with a pump means for circulating tempered water therethrough.

30. The multi-zone common support air conditioning system as set forth in claim 24, wherein the water tempering means includes a tempered water storage tank and a water boiler in series in the tempering circuit, and with pump means for circulating tempered water therethrough.

31. The multi-zone common support air conditioning system as set forth in claim 25, wherein the water tempering means includes a tempered water storage tank and a water boiler in series in the tempering circuit, and with pump means for circulating tempered water therethrough.

32. The multi-zone common support air conditioning system as set forth in claim 22, wherein the ice maker and ice water storage means includes pump means for circulating ice water at substantially 35° to 40° F. through the cooling circuit.

33. The multi-zone common support air conditioning system as set forth in claim 22, wherein the tempering circuit includes a supply pipe of an automatic sprinkler system having a pipe with sprinklers extending to a return pipe of the tempering circuit, the supply pipe thereof being connected into a Utility water supply main.

34. The multi-zone common support air conditioning system as set forth in claim 22, wherein the tempering circuit includes a supply pipe of an automatic sprinkler system having a pipe with sprinklers extending in parallel with at least one of the air conditioners and to a return pipe of the tempering circuit, the supply pipe thereof being connected into a Utility water main.

35. The multi-zone common support air conditioning system as set forth in claim 22, wherein at least one of the air conditioners is of the Variable Air Volume type having a variable air volume control means circulating air therethrough in response to air flow restriction imposed by an intake duct damper means controlling return of zone space air.

36. The multi-zone common support air conditioning system as set forth in claim 22, wherein at least one of the air conditioners is of the Variable Air Volume type having a variable air volume control means circulating air therethrough in response to air flow restriction imposed by a supply duct damper means controlling delivery of zone space air.

37. The multi-zone common support air conditioning system as set forth in claim 22, wherein at least one of the air conditioners is of the Variable Air Volume type having a variable air volume control means circulating air therethrough in response the speed control means regulating air delivery by the blower means.

38. The multi-zone common support air conditioning system as set forth in claim 22, wherein at least one of the air conditioners is of the Variable Air Volume type having a by-pass air duct extending between the intake air duct and the supply air duct and with a variable air volume control means recirculating air therethrough in response to supply air restriction imposed by a zone space damper means controlling circulation of zone space air.

39. A multi-zone off-peak thermal storage and on-peak energy saving air conditioning system comprised of a multiplicity of air conditioners serving separate zone spaces to be conditioned, and a common support system for said multiplicity of air conditioners, each air conditioner comprising a powered refrigeration compressor directly refrigerant through a heat exchanger coil and through an air handling coil, an air intake duct from its zone space and delivering air from the zone space and through the air handling coil, a supply air duct delivering conditioned air into the zone space from the air handling coil, and blower means delivering the air therethrough, and at least one of the air conditioners being a heat pump with a reversing valve means directing refrigerant in alternate directions through the heat exchange coil and through the air handling coil thereof, each air conditioner having a wet economizer air cooling coil in the intake duct upstream of the air handling coil and with valve means to open alternately through a cooling circuit and a tempering circuit, and having a charging coil downstream of the air handling coil and with valve means to open into the cooling circuit, each air conditioner having a control means alternately switching its valve means to a cooling mode and a heating mode, the common support system comprising an ice maker and ice storage means in series with a cold water storage tank and circulating water through the cooling circuit, and a water tempering means in series with a tempered water storage tank and circulating water through the tempering circuit, and control means activating the powered refrigeration compressos during off-peak power periods and deactivating the same during on-peak power periods.

40. The multi-zone common support air conditioning system as set forth in claim 39, wherein the at least one air conditioner is an air source heat pump with air circulation through the heat exchange coil thereof.

41. The multi-zone common support air conditioning system as set forth in claim 39, wherein the at lesat one air conditioner is a water source heat pump with a liquid to liquid heat exchange coil connected by valve means into the tempering circuit.

42. The multi-zone common support air conditioning system as set forth in claim 29, wherein the ice maker and ice water storage means includes a chilled water storage tank and an ice water storage vessel in series in the cooling circuit, and with pump means for circulating water therethrough, and valve means therein by-passing the ice storage vessel.

43. The multi-zone common support air conditioning system as set forth in claim 29, wherein the water tempering means includes a tempered water storage tank and a cooling tower means in series in the tempering means circuit, and with pump means for circulating water therethrough, and valve means therein by-passing the cooling tower means.

44. The multi-zone common support air conditioning system as set forth in claim 39, wherein the ice maker and ice water storage means comprises a powered refrigeration compressor directing refrigerant through an ice forming storage vessel, and a condenser dissipating heat from a cooling tower means, and wherein the control means activates the powered ice maker and ice water storage means compressor during off-peak power periods and deactivates the same during on-peak power periods.

45. The multi-zone common support air conditioning system as set forth in claim 44, wherein the cooling tower means is in series with the tempering means circuit.

46. The multi-zone common support air conditioning system as set forth in claim 41, wherein a pump means circulates tempered water at substantially 55° to 90° F. therethrough.

47. The multi-zone common support air conditioning system as set forth in claim 41, wherein the water tempering means includes a water boiler in series in the tempering means circuit, and with pump means for circulating tempered water therethrough.

48. The multi-zone common support air conditioning system as set forth in claim 44, wherein there is a water boiler is series in the tempering means circuit, and with pump means for circulating tempered water therethrough.

49. The multi-zone common support air conditioning system as set forth in claim 39, wherein the ice maker and ice water storage means includes pump means for circulating ice water at substantially 35° to 40° F. from the cold water storage tank and through the cooling means circuit.

50. The multi-zone common support air conditioning system as set forth in claim 39, wherein the tempering circuit includes a supply pipe of an automatic sprinkler system having a pipe with sprinklers extending to a return pipe of the tempering circuit, the supply pipe thereof being connected into a Utility water supply main.

51. The multi-zone common support air conditioning system as set forth in claim 39, wherein the tempering circuit includes a supply pipe of an automatic sprinkler system having a pipe with sprinklers extending in parallel with at least one of the air conditioners and a return pipe of the tempering circuit, the supply pipe thereof being connected into a Utility water main.

52. The multi-zone common support air conditioning system as set forth in claim 39, wherein at least one of the air conditioners is of the Variable Air Volume type having a variable air volume control means circulating air therethrough in response to air flow restriction imposed by an intake duct damper means controlling return of zone space air.

53. The multi-zone common support air conditioning system as set forth in claim 39, wherein at least one of the air conditioners is of the Variable Air Volume type having a variable air volume control means circulating air therethrough in response to air flow restriction imposed by a supply duct damper means controlling delivery of zone space air.

54. The multi-zone common support air conditioning system as set forth in claim 39, wherein at least one of the air conditioners is of the Variable Air Volume type having a variable air volume control means circulating air therethrough in response to the speed control means regulating air delivery by the blower means.

55. The multi-zone common support air conditioning system as set forth in claim 39, wherein at least one of the air conditioners is of the Variable Air Volume type having a by-pass air duct extending between the intake air duct and the supply air duct and with a variable air volume control means recirculating air therethrough in response to supply air restriction imposed by a zone space damper means controlling circulation of zone space air.

* * * * *

UNITED STATES PATENT AND TRADEMARK OFFICE

CERTIFICATE OF CORRECTION

PATENT NO. :4,815,527

DATED :Mar. 28, 1989

INVENTOR(S) :MILTON MECKLER

It is certified that error appears in the above—identified patent and that said Letters Patent is hereby corrected as shown below:

Col. 2 line 61, change "storae" to --storage--; Col. 3 line 64, change "pipe 55°- 90° F." to -- 55°- 90° F. pipe -- ; Col. 4 line 22, change "coi" to --coil--; Col. 4 line 38, change "coi" to --coil--; Col. 5 line 11, change "multiplifity" to --multiplicity--; Col. 5 line 31, change "economozer" tp --economizer--; Col. 6 line 2, change "sypply" to --supply--; Col. 6 line 51, change "colled" to --cooled--; Col. 7 line 11, change "return" to --supply--; Col. 7 line 31, change "reverse" to --reserve--; Col. 7 line 45, change "receisve" to --receive--; Col.8 line 30, change "30" to --39--; Col. 8 line 32, delete"53'"; Col. 8 line 59, after "by" inset --a--; same line,delete "55"; Col. 10 line 12, change "stroage" to --storage--;Col. 10 line 24, after "whereas" change "is" to --it--; Col. 10 line 26, change "coolint" to --cooling--; Col. 10 line 30, change "it" to --is--; Col. 10 line 60, change "Anothe" to --Another--; Col. 11 line 4, change "capactity" to --capacity--; Col. 11 line 24, change "charing" to--charging--; Col. 11 line 43, change "spaced" to --space--; Col. 12 line 19, change "seprate" to --separate--; Col. 13 line 32, change "40" to --40°--; Col. 14 line 60, delete "and"; Col. 14 line 61, before "ice" insert --an--; Col. 15 line 12, change "power" to --powered--; Col. 15 line 17, after "off" insert a hyphen;

UNITED STATES PATENT AND TRADEMARK OFFICE

CERTIFICATE OF CORRECTION

PATENT NO. : 4,815,527

DATED : Mar. 28, 1989

INVENTOR(S) : MILTON MECKLER

It is certified that error appears in the above—identified patent and that said Letters Patent is hereby corrected as shown below:

Col. 16 line 66, change "compressos" to --compressor --; Col. 17 line 6, change "lesat" to --least--; Col. 17 line 12, change "29" to --39--; Col. 17 line 19, change "29" to --39--; And, Col. 7 line 32, change " verse" to --serve--.

Signed and Sealed this

Twenty-sixth Day of December, 1989

*Attest:*

JEFFREY M. SAMUELS

*Attesting Officer* *Acting Commissioner of Patents and Trademarks*